US007011493B2

(12) United States Patent
Marchi et al.

(10) Patent No.: US 7,011,493 B2
(45) Date of Patent: Mar. 14, 2006

(54) TURBOMACHINE WITH COOLED RING SEGMENTS

(75) Inventors: Marc Marchi, Le Mee sur Seine (FR); Paul Rodrigues, Savigny sur Orge (FR); Patrice Rosset, Le Mee sur Seine (FR); Jean-Claude Taillant, Vaux le Penil (FR); Jean-Baptiste Arilla, Lanne En Baretous (FR)

(73) Assignee: Snecma Moteurs, Paris (FR)

( * ) Notice: Subject to any disclaimer, the term of this patent is extended or adjusted under 35 U.S.C. 154(b) by 72 days.

(21) Appl. No.: 10/790,116

(22) Filed: Mar. 2, 2004

(65) Prior Publication Data

US 2004/0219009 A1 Nov. 4, 2004

(30) Foreign Application Priority Data

Mar. 6, 2003 (FR) ..... 03 02783

(51) Int. Cl.
*F01D 25/12* (2006.01)

(52) U.S. Cl. ..... 415/116; 415/173.1; 415/213.1

(58) Field of Classification Search ..... None
See application file for complete search history.

(56) References Cited

U.S. PATENT DOCUMENTS

| | | | | |
|---|---|---|---|---|
| 2,843,357 A | | 7/1958 | Spindler, Jr. | |
| 2,863,634 A | | 12/1958 | Chamberlin, et al | |
| 3,000,552 A | | 9/1961 | Cooper, Jr. et al. | |
| 3,126,149 A | | 3/1964 | Bowers, Jr. et al. | |
| 3,864,056 A | * | 2/1975 | Gabriel et al. | 415/178 |
| 4,317,646 A | * | 3/1982 | Steel et al. | 415/116 |
| 4,522,559 A | | 6/1985 | Burge et al. | |
| 4,529,355 A | | 7/1985 | Wilkinson | |
| 5,088,888 A | * | 2/1992 | Bobo | 415/170.1 |
| 5,131,811 A | | 7/1992 | Johnson | |
| 5,288,206 A | | 2/1994 | Bromann et al. | |
| 6,334,755 B1 | | 1/2002 | Coudray et al. | |
| 6,575,697 B1 | | 6/2003 | Arilla et al. | |

FOREIGN PATENT DOCUMENTS

| | | |
|---|---|---|
| DE | 734 440 | 4/1943 |
| DE | 1 172 900 | 6/1964 |
| EP | 1 219 783 | 7/2002 |
| FR | 1 138 118 | 6/1957 |
| FR | 1 227 668 | 8/1960 |
| FR | 2 522 067 | 8/1983 |
| FR | 2 683 851 | 5/1993 |
| FR | 2 800 797 | 5/2001 |
| GB | 856599 | 12/1960 |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A turbomachine includes a casing, a rotor, and a plurality of cooled ring segments installed between the casing and the rotor, each ring segment containing a main cooling cavity and being attached to the casing by a fastening device. The fastening device can include a clamping screw positioned more or less radially and pinning the ring segment against the casing. The clamping screw is crossed through by a cooling airway that communicates with the main cooling cavity of the ring segment.

21 Claims, 5 Drawing Sheets

TURBOMACHINE WITH COOLED RING SEGMENTS

TECHNICAL FIELD

This invention pertains generally to turbomachines with cooled ring segments.

More specifically, the invention relates to a turbomachine comprising a casing, a rotor and a plurality of cooled ring segments installed between the casing and the rotor, each of these sectors being provided with at least one cooling cavity.

The ring segments can equally well be turbine (preferably high pressure turbine) ring segments, or compressor ring segments. On this account, it is specified that the invention finds particular (but not exclusive) application in the turbines of turbomachines, insofar as the high surrounding thermal stresses require the presence of such cooled ring segments.

PRIOR ART

FIG. 1 shows a partial view of a portion of a high pressure turbine of a turbomachine 1 according to the prior art, as described in document FR-A-2 800 797.

As can be seen in this figure, the high pressure turbine comprises a turbine casing 2, as well as a rotor 4, of which only one end of the blades 6 is shown.

The turbine is also provided with a number of cooled ring segments 8 mounted on the turbine casing 2, and forming a ring around the blades 6 of the rotor 4.

The ring segments 8 are attached to the casing 2 by means of a hook on the upstream side of the casing 2 that is designed to connect with a second hook 12 on the ring segment 8. Thus, once hooks 10 and 12 have mated, the other end of the ring segment 8 can then swing around until it rests against the turbine casing 2 on the downstream side, so that the flanges 14 and 16 are touching.

The ring segment 8 is then secured to the casing 2 in the axial direction by means of a tenon 18 attached to a downstream section of this segment, this tenon 18 being situated upstream of the flange 14 of the ring segment 8, and adjacent to an inner chamber 20 that is partly bounded by the turbine casing 2.

Also as shown in FIG. 1, the tenon 18 is housed in a mortise 22 formed within the flange 16 of the casing and held in place by means of an elastic tab 24 that takes up any axial play in the tenon 18 once the segment is installed.

Each ring segment 8 is also held tangentially relative to the casing 2 by means of a clip 26 the legs of which clamp the flanges 14 and 16 together. Opposing notches 28 and 30 are provided in the flanges 14 and 16 to receive the web of the clip 26 as it is pushed in the upstream direction.

The system for attaching the ring segments to the casing is therefore of very complex design and thus relatively costly.

Moreover, the tenon and mortise connection used between the casing and each ring segment does not provide a perfect seal. Leaking therefore occurs between these two elements, which naturally has a detrimental effect on the cooling of the ring segments and the thermal protection of the turbine casing.

The internal chamber 20 is also supplied with cooling air via one or more cooling openings 27 formed through the casing 2. This cooling air may, for example, be drawn from one of the compressors (not shown) of the turbomachine 1. Once it enters the inner chamber 20, the cooling air passes through a perforated panel 23 of the ring segment 8 in order to enter a cooling cavity 25 contained within it.

From the above, therefore, it is clear that the means necessary for directing the air to the cooling cavity, such as the cooling openings formed in the casing, serve to further complicate the design of the turbomachine.

DISCLOSURE OF THE INVENTION

The purpose of the invention is therefore to propose a turbomachine comprising a casing, a rotor and a plurality of cooled ring segments installed between the casing and the rotor, that at least partially remedies the above-stated disadvantages of the turbomachines produced in accordance with the prior art.

To achieve this, the invention relates to a turbomachine comprising a casing, a rotor, together with a plurality of cooled ring segments installed between the casing and the rotor, each ring segment containing a main cooling cavity and being attached to the turbine casing by means of a fastening device comprising a clamping screw positioned more or less radially and pinning the ring segment against the casing. The clamping screw is crossed through by a cooling airway that communicates with the main cooling cavity of the ring segment.

Advantageously, the fastening device is of much simpler design than that of the system described previously, insofar as they no longer require very accurately dimensioned hooks and clips, but instead consist essentially of a simple clamping screw.

Furthermore, the radial clamping screw arrangement allows the ring segment to be very accurately positioned, axially and tangentially, relative to the turbine casing, thus considerably reducing cooling air leakage between these elements. In this way, the turbine casing has improved thermal protection and the ring segments can be properly cooled.

The fastening device used in the invention also simplify installation and reduce costs in comparison to those of the prior art described above and shown in FIG. 1.

The fact of providing one or more airways through the screw also allows the fastening device of each ring segment to be advantageously combined with the means required for routing cooling air to the cooling cavity of the ring concerned. With such an arrangement, the cooling air drawn from the desired location, such as a compressor of the turbomachine, for example, enters a radial outer end of the airway, then passes through the airway and is then discharged through a radial inner end into the main cooling cavity where it thus serves to cool the ring segment.

The clamping screw of each ring segment will preferably have a single cooling airway running longitudinally through it, which thus emerges notably from the head of the screw.

The fastening device of each ring segment will preferably comprise a spacer mounted on the casing through which the clamping screw will pass, this spacer serving to position the ring segment relative to the casing axially and tangentially, as well as to provide the required level of pre-stress. This can be achieved by ensuring that, for each ring segment, the internal diameter of the spacer is approximately equal to the external diameter of at least a section of the opposing clamping screw and/or the spacer comprises a lower section that is inserted in a hole bored on the ring segment, the external diameter of this lower section being approximately equal to the internal diameter of the hole.

For each ring segment, the spacer preferably forms a limit stop for that same ring segment, in such a way as to position it radially with respect to the casing. Thus, with such a configuration, a single spacer judiciously positioned on the casing would enable the ring segment to be very accurately positioned relative to it in the axial, tangential and radial directions.

Each ring segment preferably comprises a threaded section that cooperates with the clamping screw, the head of this screw bearing against an upper extremity of the spacer. Regarding this, it should be noted that another solution for pinning the ring segment against the casing could consist in forming a recess in each ring segment against the bottom of which the head of the clamping screw would bear, this clamping screw cooperating with a nut bearing against an upper extremity of the spacer passing through the casing Moreover, each ring segment can comprise an upstream end and a downstream end, the upstream end being in contact with a circular rim belonging to the casing, and the downstream end being in contact with a circular rim also belonging to the same casing.

Finally, each ring segment can also include a secondary cooling cavity separated from the main cooling cavity by a panel, the main and secondary cavities being radially superimposed.

Other advantages and features of the invention will be given in the non-limiting detailed description below.

BRIEF DESCRIPTION OF THE DRAWINGS

This description will be made with reference to the appended drawings, including:

FIG. 4 shows an enlarged view of a part of the turbomachine, similar to that shown in FIG. 2, constituting an alternative to the first preferred embodiment of to a first preferred embodiment of the.

DETAILED DESCRIPTION OF PREFERRED EMBODIMENTS

Figure 1:
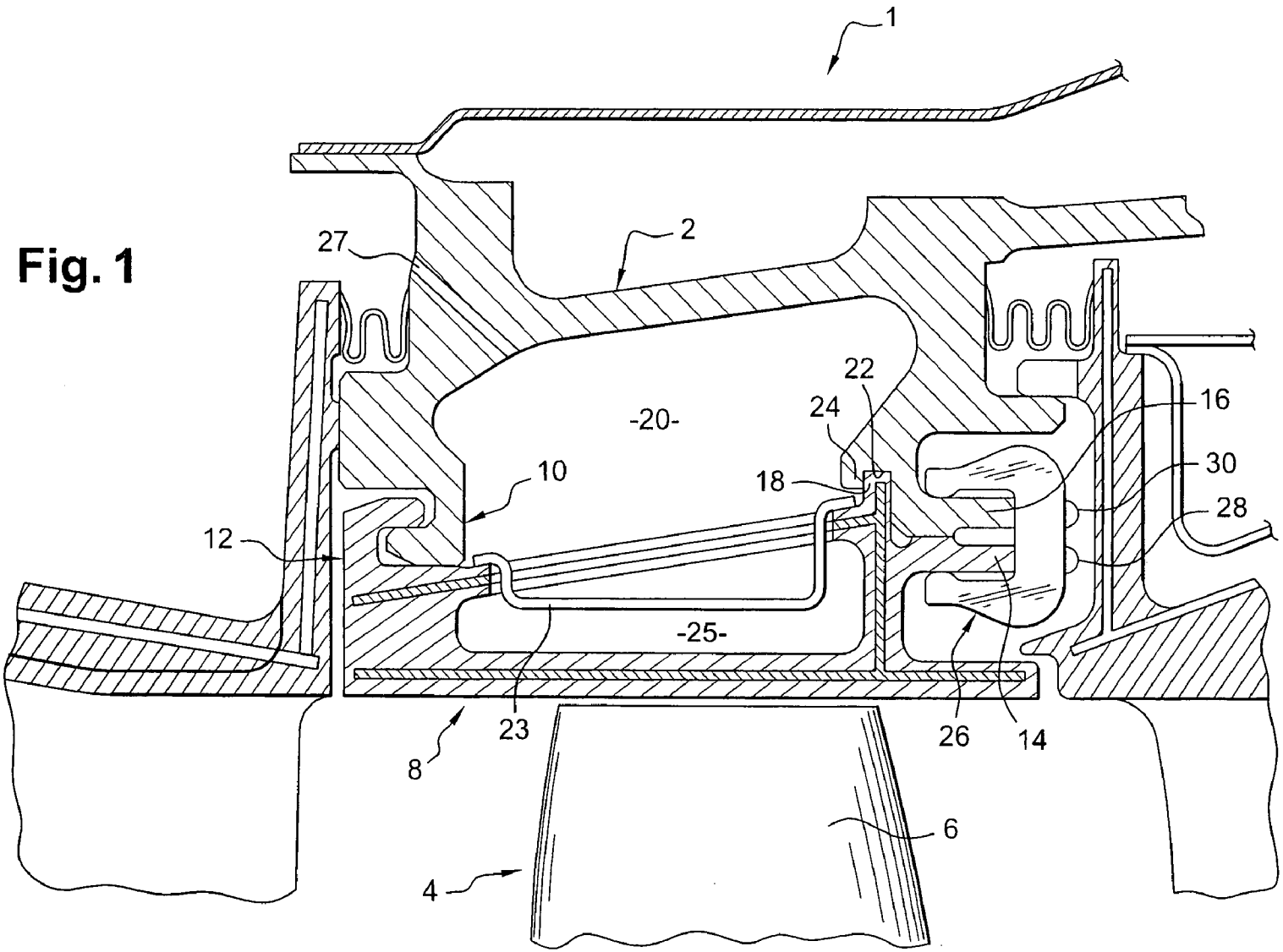
FIG. 1, previously described, shows part of a high pressure turbomachine turbine as constructed according to the prior art.
Figure 2:
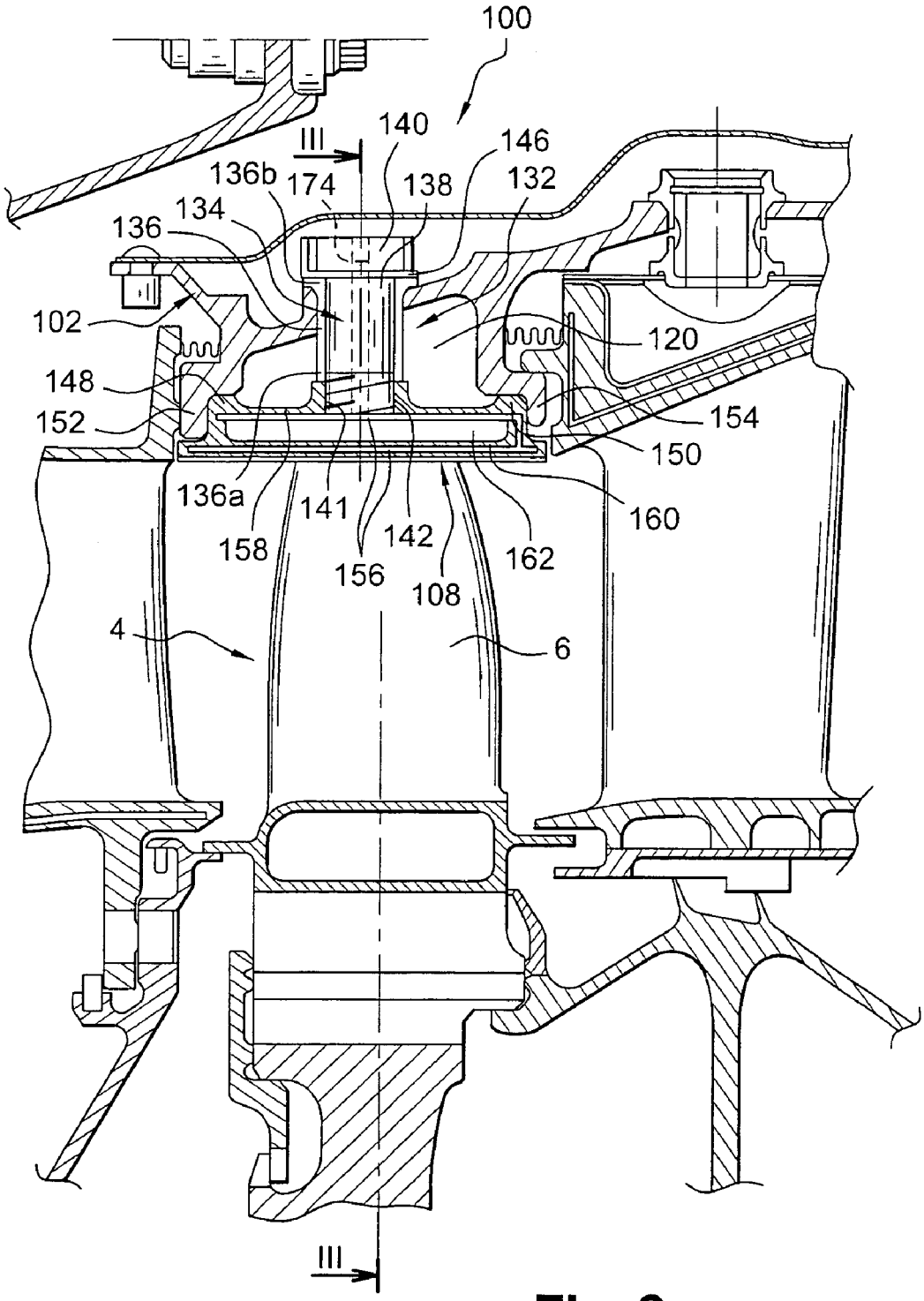
FIG. 2 shows a partial longitudinal cross section of a turbomachine according to a first preferred embodiment of the present invention.
Figure 3:
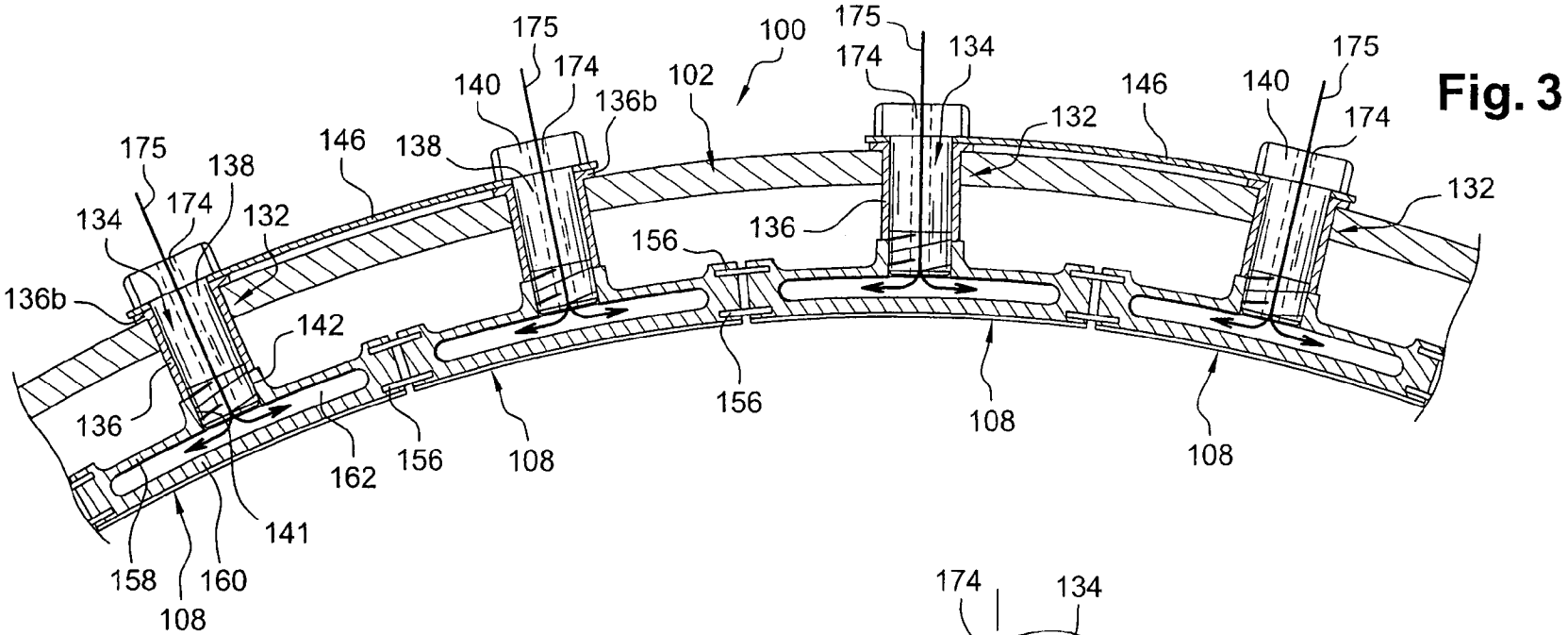
FIG. 3, shows a partial cross-section along line III—III of FIG. 2.

Referring to FIGS. 2 and 3, these show a partial representation of a turbomachine 100 according to a first preferred embodiment of the present invention.

The turbomachine comprises a casing 102 as well as a rotor 4 with blades 6. Therefore, as the invention finds particular application when applied to a turbine of the turbomachine 100, we will consider for the remainder of the description that the section shown in FIGS. 2 and 3 corresponds to a high pressure turbine of this turbomachine and that the casing 102 and the rotor 4 thus correspond respectively to a turbine casing 102 and a turbine rotor 4 fitted with blades 6. It is noted that this choice of application of the invention to a turbine (preferably the high pressure turbine subjected to high thermal stresses) will be adopted for all of the preferred embodiments shown in FIGS. 2 to 6, and described below.

Obviously, as has already been stated above, the invention could equally be applied to a compressor of the turbomachine and remain within the scope of the invention.

Thus, again as shown in FIGS. 2 and 3, it can be seen that the turbine comprises a number of cooled ring segments 108 attached to the turbine casing 102 by means of a fastening device 132, the ring segments 108 forming a ring around the blades 6 of the turbine rotor 4.

Moreover, the fastening device 132 comprises a clamping screw 134 positioned more or less radially with respect to the turbine casing 102. In other words, the clamping screw 134 is arranged in such a way that its longitudinal axis (not shown) is more or less parallel to a radial direction of the turbomachine 100.

For this, the fastening device comprises a spacer 136 that is either firmly connected to the casing (102) through which it passes or given a calibrated amount of play. As clamping screw 134 is passed through the spacer 136 (also called a "guide sleeve"), its longitudinal axis is thus also positioned more or less radially.

In this first preferred embodiment, the clamping screw 134 has a section 138, located beneath the head 140 and opposite the spacer 136, having an external diameter more or less equal to the internal diameter of the spacer 136. Hence, because the clearance between the screw 134 and the spacer 136 is virtually nil, the clamping screw 134 is then very accurately positioned, axially and tangentially, relative to the turbine casing 102, insofar as the casing is attached to the spacer, e.g., by welding, or else assembled with virtually zero clearance.

Regarding this, it should be noted that ring segment 108 has a threaded section 141 that cooperates with the threaded section 142 of the clamping screw 134. In this way, when the ring segment 108 cooperates with the clamping screw 134, it is also very accurately positioned axially and tangentially relative to the turbine casing 102.

Figure 4:
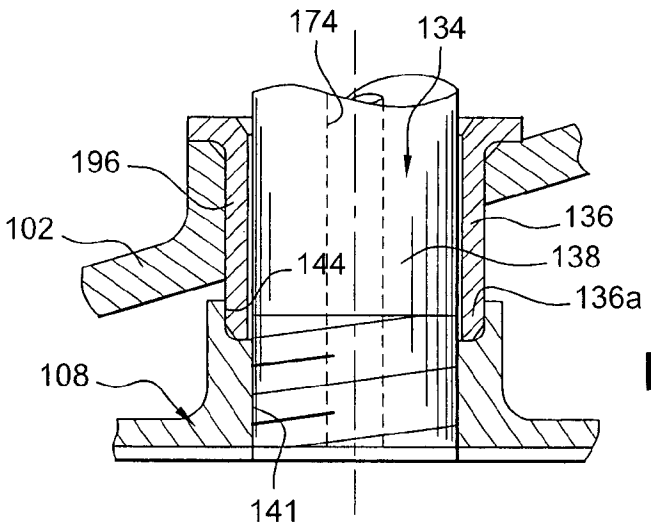

With reference to FIG. 4, it should be noted that an alternative method for positioning the ring segment 108 relative to the casing 102 could consist in providing for spacer 136 to comprise a lower end **136*a* that is inserted in a hole 144 bored in the ring segment 108, the external diameter of the lower end 136*a* being approximately the same as the internal diameter of the hole 144. Such an arrangement would avoid the need for the internal diameter of the spacer 136 to be identical to the external diameter of portion 138 of clamping screw 134**.

With reference again to FIGS. 2 and 3, it is noted that the head 140 of the screw 134 situated radially externally with respect to the threaded section 142, is bearing against an upper end **136*b* of the spacer 136. An anti-rotation wedge 146 can eventually be inserted between this upper end 136*b* and the head 140 of screw 134**, to prevent it from coming loose after assembly.

Regarding this, it is specified that the action of screwing the clamping screw 134 into the ring segment 108 causes the latter to move radially outwards, until it comes into contact with the turbine casing 102. As can be seen in FIG. 2, contact is made by an upstream boss 148 and a downstream boss 150 provided on an upper part of the ring segment 108. Thus, once clamped in place, the ring segment 108 and the casing 102 form a closed inner chamber that leaks considerably less than those found on prior art constructions.

Moreover, it is specified that the lower end **136*a* of the spacer 136 can also constitute a limit stop for the ring segment 108, in such a way as to very accurately position it radially with respect to the turbine casing 102, or to provide a controlled level of pre-stress. Clearly, in such a case, the size of the spacer 136 is set so that when the ring sector 108 comes into contact with its lower extremity 136***a,* the bosses 148 and 150 of that same ring segment simultaneously bear against the casing 102.

Moreover, in order to further reduce leakage from the inner chamber 120, the turbine is designed in such a way that the ring segment 108 has an upstream extremity or upstream edge in contact with a circular rim 152 belonging to the turbine casing 102, as well as a downstream extremity or downstream edge in contact with a circular rim 154 belonging to the same casing. We would note by way of example, as shown in FIG. 2, that the contact surfaces between rims 152 and 154 and the ring segment 108 are preferably flat, and contained in planes that are more or less perpendicular to the main longitudinal axis (not shown) of the turbomachine 100.

Moreover, it is noted that the ring segments 108 are connected together in a relatively traditional manner, by means of sealing strips 156, to limit the circulation of gasses in the axial and radial directions.

In this preferred embodiment of the present invention, each ring segment 108 has an upper panel 158 and a lower panel 160 that are radially superimposed and define a main cooling cavity 162, these two panels being either separately formed and assembled together or made of one piece.

It is specified that in the first preferred embodiment shown in FIGS. 2 to 4, each ring segment 108 has no cooling cavity other than the main cooling cavity 162.

In order to ensure the supply of cooling air to the cavity 162, the clamping screw 134 has one or more cooling airways 174 running through it, preferably only one, formed in such a way as to communicate with the main cavity 162. Cooling air can be drawn, for example, from a compressor of the turbomachine 100, then routed to an external radial extremity (not numbered) of the airway 174, this external extremity being situated radially externally with respect to the turbine casing 102. Moreover, insofar as the threaded section 141 emerges directly inside the cooling cavity 162, it is clear that the internal radial extremity (not numbered) of the airway 174 communicates with this same cavity 162, in such a way that the air discharged from this inner radial extremity can then enter into the main cooling cavity 162 and cool the ring segment 108. For illustrative purposes, the path of the cooling air described above is shown diagrammatically by arrow 175 in FIG. 3.

The cooling airway 174 is preferably centred on the centreline of the clamping screw 134 and of cylindrical shape with a circular cross-section. Moreover, it is noted that the required air flow can be obtained by directly calibrating the airway 174, or else by placing calibrated washers (or plates) inside these airways 174. Naturally, the advantage of the latter solution resides in the fact that when it is wished to modify the flow rate of the cooling air passing through the airways 174, this can be done simply by changing the washers (not shown). Moreover, this solution using plates also enables different air flow rates to be provided at each stage of the turbine while using the same size of hollow screw.

Referring more specifically to FIG. 2, the upper panel 158 helps to define the inner chamber 120, into which cooling air can also be introduced. Thus, the cooling air entering chamber 120 can also reach the cooling cavity 162 via through-holes (not shown) formed in the upper panel 158, in such a way as to allow the ring segments 108 to be cooled by direct impact on the panel of the cavity. In such a case, it should be understood that the cooling cavity 162 is then supplied with air by two separate air flows drawn respectively, for example, from the high pressure compressor and the low pressure compressor of the turbomachine 100.

However, other solutions for cooling the ring segments 108 of the high pressure turbine can also be envisaged.

Figure 5:
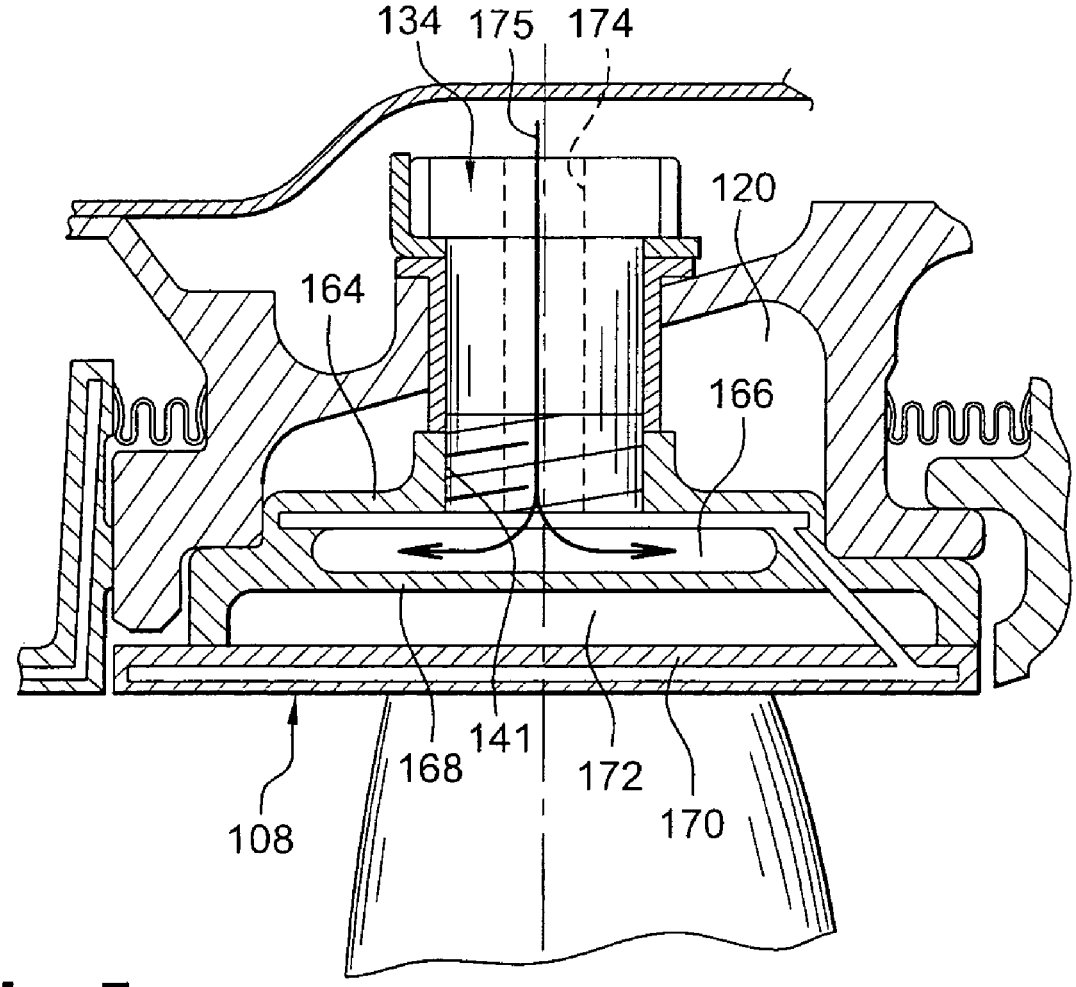
FIG. 5 shows a enlarged partial view of a turbomachine similar to that shown in FIG. 2, constituting another alternative too the first preferred embodiment of the present invention.

By way of an example and with reference to FIG. 5, the ring segment 108 comprises an upper panel 164 defining a main cooling cavity 166 with an intermediate panel 168, also called the "impact panel". Moreover, segment 108 has a lower panel 170 defining a secondary cooling cavity 172 with the help of the intermediate panel 168. Thus, the two cavities 166 and 172 are radially superimposed, the main cavity 166 being small in size than the secondary cavity, for example.

In this way, the cooling air discharged from the internal radial extremity of the airway 174 enters the main cavity 166 in an identical manner to that indicated above, then is able to enter the secondary cavity 172 via through-holes (not shown) formed in the intermediate panel 168. In this way, the ring segments 108 can be cooled by impact or convection.

Moreover, here again, the cooling air located within the inner chamber 120 is able to enter the cavity 166 via through-holes (not shown) formed in the upper panel 164. As can be seen in FIG. 5, the upper panel 164 has the threaded section 141 necessary for fixing the ring segment 108 onto the clamping screw 134, this threaded section 141 emerging into the main cavity 166.

There are therefore two air flows, coming from the airway 174 and the inner chamber 120 respectively, that are able to enter into the main cavity 166 where they will be mixed together before entering the secondary cavity 172 via the aforementioned through-holes formed in the intermediate panel 168.

Figure 6:
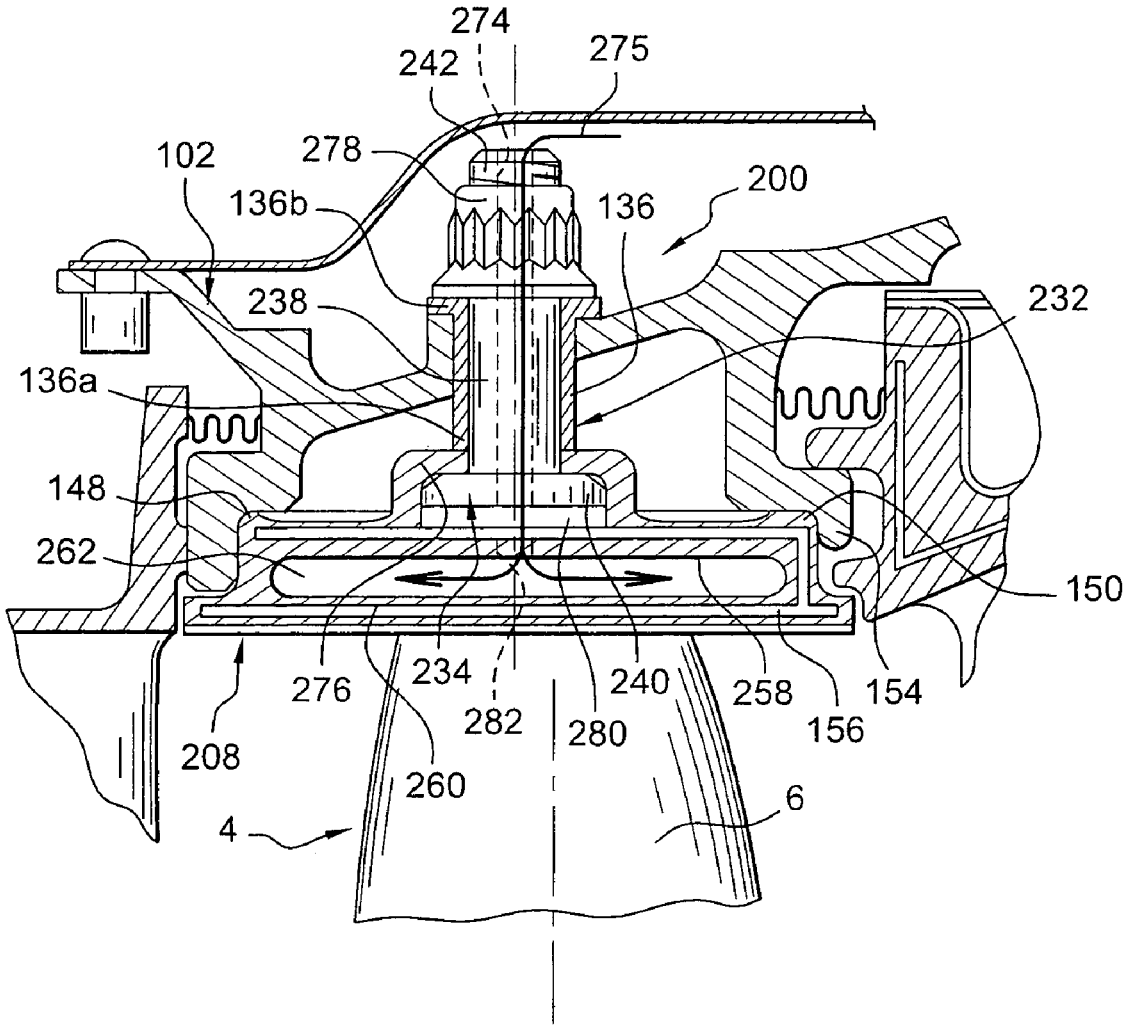
FIG. 6 shows a partial longitudinal cross section through a turbomachine according to a second preferred embodiment of the present invention.

Referring to FIG. 6, this shows a partial representation of a turbomachine according to a second preferred embodiment of the present invention.

The elements FIG. 6 that bear the same numerical references as those attaching to the elements shown in FIGS. 1 to 5, correspond to identical or similar elements.

This allows it to be seen that the turbomachine 200 according to the second preferred embodiment of the present invention is broadly similar to the turbomachine 100 according to the first preferred embodiment.

The main difference lies in the fastening device 232 used to attach the cooled ring segments 208 to the turbine casing 102. Indeed, while the spacer 136 is similar to that presented in the first preferred embodiment, this is not the case for the clamping screw 234. The head of this clamping screw 234 can precisely fit into the bottom of a recess 276 belonging to an upper section of the ring segment 208, this recess 276 defining a space 280 in conjunction with an upper panel 258 of the ring segment 208, situated radially internally relative to the recess 276.

Thus, the cooperation between the spacer 136 and a portion of the screw 234 located opposite this spacer, together with the cooperation between the head 240 of the clamping screw 234 and the recess 276 of the ring segment 208, allows the ring segment to be accurately positioned axially and tangentially relative to the turbine casing 102.

Furthermore, the clamping screw 234 comprises a threaded section 242 that extends beyond the spacer 136 towards the outside, and that cooperates with a nut 278 bearing against the upper extremity 136*b* of the spacer 136, the nut 278 thus being situated radially externally relative to the casing 102. Consequently, tightening the nut 278 causes the ring segment 208 to move radially outwards until it comes into contact with the turbine casing 102. As can be seen in FIG. 6, contact is made by an upstream boss 148 and a downstream boss 150 provided on an upper part of the ring segment 208. Furthermore, as previously indicated, the movement of the ring segment 208 in the radial direction could be simultaneously arrested by the entry into contact of the ring segment with the lower extremity 136*a* of the spacer 136.

Moreover, here again, each ring segment 208 uses the upper panel 258 and a lower, radially superimposed, lower panel 260 to define a main cooling cavity 262, and being either assembled together or made of one piece.

In order to ensure the supply of cooling air to the cavity 262, the clamping screw 234 has one or more cooling airways 274 running through it, preferably only one, formed in such a way as to communicate with the main cavity 262. Cooling air can be drawn, for example, from a compressor of the turbomachine 200, then routed to an external radial extremity (not numbered) of the airway 274, this external extremity being situated radially externally relative to the turbine casing 102. Moreover, insofar as the screw head 240 is positioned inside the space 280, it is clear that the internal radial extremity (not numbered) of the airway 274 is in communication with this same space 280, which is itself in communication with the cavity 262 via one or more through-holes 282 formed in the upper panel 258. With such a configuration, the cooling airway 274 communicates with the main cavity 262, in such a way that the air discharged from the inner radial extremity can then enter into the cavity 262 and cool the ring segment 208. For illustrative purposes, the path of the cooling air described above is shown diagrammatically by arrow 275 in FIG. 6.

The cooling airway 274 is preferably centred on the centreline of the clamping screw 234 and also of cylindrical shape with a circular cross-section. Here again, it is noted that the required air flow can be obtained by directly calibrating the airway 274, or else by placing calibrated washers (or plates) inside these airways 274.

Obviously, the alternatives proposed for the turbomachine 100 according to the first preferred embodiment of the present invention and shown in FIGS. 4 and 5 are also applicable to turbomachine 200 according to the second preferred embodiment.

The ring segments 208 are installed by proceeding as follows.

Firstly place the clamping screws 234, the different ring segments 208 and the sealing strips 156 in position before installing the spacers 136 on the casing 102, in such a way that the ring segments 208 are each free to move tangentially to enable the installation of the strips 156.

The spacers 136 are then installed on the turbine casing 102 in such a way that the clamping screws 234 pass through them. Thus, the ring segments 208 which are offset from their final position can be rotated until the heads 240 enter into their respective recesses 276.

Assembly is completed and a fixed ring formed around the blades 6 of the turbine rotor 4, by tightening each of the nuts 278 on the threaded sections 242 of the clamping screws 234.

Of course, various modifications can be made by a person skilled in the art to the turbomachines 100 and 200 herein described by way of non-limiting examples only.

What is claimed is:

1. A turbomachine comprising:

a casing, a rotor, and a plurality of cooled ring segments situated between said casing and said rotor, each ring segment comprising a main cooling cavity and being attached to the casing by a fastening device comprising a clamping screw positioned more or less radially and pinning the ring segment against said casing and wherein said clamping screw is crossed through by a cooling airway that communicates with said main cooling cavity of the ring segment.

2. The turbomachine according to claim 1, wherein for each ring segment said clamping screw is crossed longitudinally by a single cooling airway.

3. The turbomachine according to claim 1, wherein for each ring segment the fastening device comprises a spacer mounted on the casing and through which the clamping screw passes, said spacer serving to position the ring segment axially and tangentially relative to the casing.

4. The turbomachine according to claim 3, wherein for each ring segment said spacer has an internal diameter that is more or less equal to an external diameter of at least a section of said clamping screw situated opposite the spacer.

5. The turbomachine according to claim 3, wherein for each ring segment said spacer comprises a lower extremity inserted in a hole bored in said ring segment, this lower extremity having an external diameter more or less equal to an internal diameter of said hole.

6. The turbomachine according to claim 3, wherein for each ring segment said spacer includes a limit stop for said ring segment, in such a way as to position said ring segment radially with respect to the casing.

7. The turbomachine according to claim 3, wherein each ring segment comprises a threaded section cooperating with said clamping screw, the head of this clamping screw bearing against an upper extremity of the spacer.

8. The turbomachine according to claim 3, wherein each ring segment comprises a recess against the bottom of which bears the head of said clamping screw, this clamping screw cooperating with a nut bearing against an upper extremity of the spacer.

9. The turbomachine according to claim 1, wherein each ring segment comprises an upstream extremity as well as a downstream extremity, said upstream extremity being in contact with an upstream circular rim belonging to the casing, and said downstream extremity being in contact with a downstream circular rim belonging to the same casing.

10. The turbomachine according to claim 1, wherein each ring segment comprises a secondary cooling cavity separated from said main cooling cavity by a panel, said main and secondary cavities being radially superimposed.

11. The turbomachine according to claim 1, wherein the ring segments are connected together by sealing strips.

12. The turbomachine according to claim 1, wherein said casing is a turbine casing and that said rotor is a turbine rotor.

13. The turbomachine according to claim 1, wherein said clamping screw is in contact with a corresponding cooled ring segment.

14. The turbomachine according to claim 1, wherein said cooled ring segments directly face said rotor.

15. A turbomachine comprising:

a casing;

a rotor;

a plurality of ring segments between said casing and said rotor, each of said ring segments comprising a cooling cavity; and a plurality of fastening devices, each of said fastening devices being configured to maintain one of said ring segments in contact with the casing, wherein each of said fastening devices includes a cooling airway in communication with said cooling cavity of a corresponding ring segment.

16. The turbomachine according to claim 15, wherein each of said fastening devices comprises a clamping screw.

17. The turbomachine according to claim 15, wherein each of said fastening devices is positioned radially relative to the casing.

18. The turbomachine according to claim 15, wherein each of said fastening devices is configured to maintain one of said ring segments in contact with the casing via at least one boss provided on an upper part of said one of said ring segments.

19. The turbomachine according to claim 18, wherein said at least one boss comprises an upstream boss and a downstream boss.

20. The turbomachine according to claim 15, wherein each of said ring segments comprises an upstream edge in contact with an upstream rim belonging to the casing.

21. The turbomachine according to claim 20, wherein each of said ring segments further comprises a downstream edge in contact with a downstream rim belonging to the casing.

* * * * *